US005759354A

United States Patent [19]

Graf

[11] Patent Number: 5,759,354

[45] Date of Patent: Jun. 2, 1998

[54] PAPER MACHINE INCLUDING A HYDRAULIC CYLINDER ASSEMBLY WITH A NON-METALLIC BUSHING

[75] Inventor: Edwin X. Graf, Menasha, Wis.

[73] Assignee: Voith Sulzer Paper Technology North America, Inc., Appleton, Wis.

[21] Appl. No.: 645,519

[22] Filed: May 14, 1996

[51] Int. Cl.[6] ..... D21F 1/60

[52] U.S. Cl. ..... 162/308; 162/357; 492/20

[58] Field of Search ..... 162/357, 355, 162/209, 262, DIG. 11, DIG. 12, 308, 294; 492/20, 16

[56] References Cited

U.S. PATENT DOCUMENTS 5,560,808 10/1996 Graf ..... 162/209

*Primary Examiner*—Donald E. Czaja
*Assistant Examiner*—Calvin Padgett
*Attorney, Agent, or Firm*—Taylor & Associates, P.C.

[57] ABSTRACT

The invention is directed to a paper machine for making or processing a paper web. The paper machine includes a roll for carrying the paper web; and a hydraulic cylinder assembly connected to the roll for moving the roll. The hydraulic cylinder assembly includes a cylinder defining a chamber, a piston disposed within the cylinder, and a piston rod connected to the piston and extending from the cylinder. The hydraulic cylinder assembly further includes a bushing connected to the cylinder and disposed around the piston rod. The bushing slidably engages the piston rod and substantially seals the cylinder chamber from the ambient environment. The bushing is formed from a non-metallic material having a tensile strength of between approximately 6500 and 12500 psi at a temperature of approximately 73° F., a coefficient of friction of between approximately 0.10 and 0.30, and a maximum continuous operating temperature of approximately 550° F.

16 Claims, 2 Drawing Sheets

PAPER MACHINE INCLUDING A HYDRAULIC CYLINDER ASSEMBLY WITH A NON-METALLIC BUSHING

BACKGROUND OF THE INVENTION

1. Field of the Invention

The present invention relates to paper machines, and, more particularly, to paper machines having movable rolls for carrying a paper web.

2. Description of the Related Art.

Paper machines, such as paper-making machines, typically include a plurality of rolls for carrying the paper web. It may be desirable for certain applications to move the entire roll or one end of the roll in at least one predetermined direction. For example, if the roll is in the form of a breast roll, it may be desirable to move the entire breast roll in a reciprocating fashion in directions transverse to the movement of the paper web. Such oscillating movement of the breast roll induces fluid sheer within the pulp suspension used to form the paper web. Moreover, it may be desirable to move at least one end of a roll to establish a predetermined loading at a nip formed with an adjacent roll. Further, it may be desirable to move at least one end of a roll for the purpose of steering the fast moving paper web carried thereby.

It is known to utilize a hydraulic cylinder assembly which forms part of a breast roll shake for shaking a breast roll. The hydraulic cylinder assembly includes a piston rod which is connected to the breast roll, and which imparts a reciprocating axial movement to the breast roll for inducing sheer within the pulp suspension. For details of the general operation of such a breast roll shake, reference is hereby made to copending U.S. patent application Ser. No. 08/391,583 (Graf), entitled "Hydraulically Actuated Breast Roll Shake," which is assigned to the assignee of the present invention and incorporated herein by reference. With such a hydraulic cylinder assembly used in a breast roll shake, a metal bushing is connected to the interior cylinder wall and slidingly engages the piston rod to seal the chamber disposed within the cylinder. In operation, the hydraulic cylinder assembly is pressurized prior to actuation such that an oil film is formed between the piston rod and the bushing. The oil film forms a hydrodynamic bearing between the piston rod and metallic bushing to inhibit metal-to-metal contact therebetween.

A problem with a hydraulic cylinder assembly as described above is that vibrations (from the hydraulic cylinder assembly or induced from the connected roll) and/or a loss in system fluid pressure may allow metal-to-metal contact to occur between the piston rod and the metal bushing. Such metal-to-metal contact may result in permanent physical damage (such as galling or the like) to the piston rod and/or metal bushing. This in turn produces an ineffective seal between the bushing and piston rod, and may require relatively expensive repairs to replace the damaged parts.

Because the rolls used in a paper machine may be quite heavy (e.g., 10,000 to 20,000 lbs), the associated working pressure of the hydraulic fluid disposed within the hydraulic cylinder assembly is also relatively high (e.g., 6,000 to 7,000 psi). The metal bushing in the hydraulic cylinder assembly described above has a sufficiently high tensile strength to withstand the relatively high operating pressures of the hydraulic fluid disposed within the cylinder. However, as described above, permanent surface damage to the piston rod and/or bushing may occur if the oil film therebetween is not maintained.

What is needed in the art is a hydraulic cylinder assembly which can be used in a paper machine under relatively high operating pressures which inhibits physical damage to the piston rod and/or bushing if the oil film therebetween is not maintained for some reason.

SUMMARY OF THE INVENTION

The present invention provides a paper machine including a hydraulic cylinder assembly which is connected to a roll, and which includes a non-metallic bushing having a relatively high tensile strength, low coefficient of friction and high operating temperature.

The invention comprises, in one form thereof, a paper machine for making or processing a paper web. The paper machine includes a roll for carrying the paper web; and a hydraulic cylinder assembly connected to the roll for moving the roll. The hydraulic cylinder assembly includes a cylinder defining a chamber, a piston disposed within the cylinder, and a piston rod connected to the piston and extending from the cylinder. The hydraulic cylinder assembly further includes a bushing connected to the cylinder and disposed around the piston rod. The bushing slidably engages the piston rod and substantially seals the cylinder chamber from the ambient environment. The bushing is formed from a non-metallic material having a tensile strength of between approximately 6500 and 12500 psi at a temperature of approximately 73° F., a coefficient of friction of between approximately 0.10 and 0.13, and a maximum continuous operating temperature of approximately 550° F.

An advantage of the present invention is that metal-to-metal contact between the piston rod and bushing is avoided, thereby preventing physical damage to the piston rod and/or bushing.

Another advantage is that the non-metallic bushing can be easily machined.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
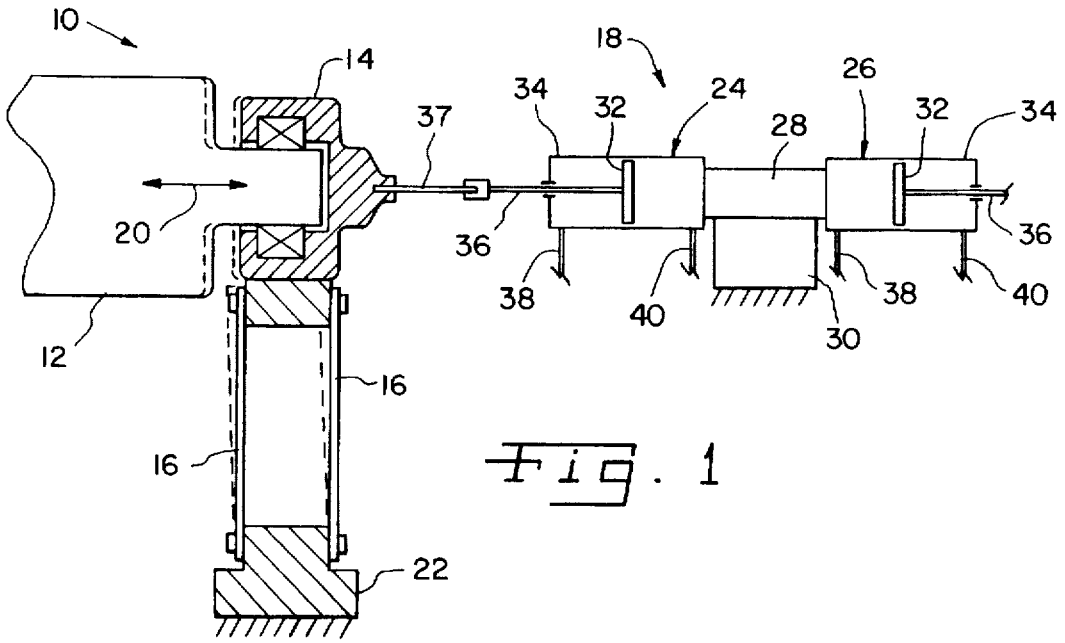
FIG. 1 is a schematic, side view of an embodiment of a pair of substantially identical hydraulic cylinder assemblies of the present invention, forming part of a breast roll shake for shaking a breast roll in a paper machine.

Referring now to the drawings, and particularly to FIG. 1, there is shown a portion of an embodiment of a paper machine 10 for making a paper web (not shown). For details of the general operation of such a paper machine, reference is hereby made to U.S. patent application Ser. No. 08/391,583, entitled "Hydraulically Actuated Breast Roll Shake," described above. In general, paper machine 10 includes a breast roll 12, bearing mount 14, fiberglass springs 16, and breast roll shake 18.

Breast roll 12 is rotatably carried at each end thereof by a bearing mount 14, one of which is shown in FIG. 1. Breast roll 12 is disposed adjacent to the outlet of a head box (not shown), and is movable in a longitudinal direction as indicated by double-ended arrow 20 so as to impart fluid sheer in the fiber suspension discharged from the head box and thereby inhibit flocculation.

Fiberglass springs 16 are connected at one end thereof with bearing mount 14, and at an opposing end thereof with a fixed surface 22. Fiberglass springs 16 are deflectable in a direction generally parallel to arrow 20, such that breast roll 12, bearing mount 14 and fiberglass springs 16 may be deflected in a direction along arrow 20 (as indicated by the illustrated phantom lines in FIG. 1).

Breast roll shake 18 includes a first hydraulic cylinder assembly 24 and a second hydraulic cylinder assembly 26 which are rigidly connected together via a coupling 28. Coupling 28 in turn is rigidly attached to a load cell 30 which is connected to appropriate electrical circuitry (not shown) for determining an actual load (substantially parallel to double-ended arrow 20) placed upon coupling 28 during operation.

First hydraulic cylinder assembly 24 and second hydraulic cylinder assembly 26 are configured substantially identical to each other in the embodiment shown in FIG. 1. Each hydraulic cylinder assembly 24, 26 includes a piston 32 which is slidably disposed within a cylinder 34. Each piston 32 includes a piston rod 36 which extends from an axial end of first hydraulic cylinder assembly 24 or second hydraulic cylinder assembly 26. Piston rod 36 of first hydraulic cylinder assembly 24 is connected to an arm 37, which in turn is connected to bearing mount 14. On the other hand, piston rod 36 of second hydraulic cylinder assembly 26 is connected to a countermass (not shown) which opposes axial movement of breast roll 12. Each of first hydraulic cylinder assembly 24 and second hydraulic cylinder assembly 26 also include fluid ports 38, 40 which are disposed in fluid communication with an inner chamber of cylinder 34. Fluid ports 38, 40 may selectively and alternatively be used as a fluid inlet or fluid outlet, such that first and second hydraulic cylinder assemblies 24, 26 act as two-way hydraulic cylinder assemblies. That is, piston rods 36 may be positively displaced in either axial direction.

Figure 2:
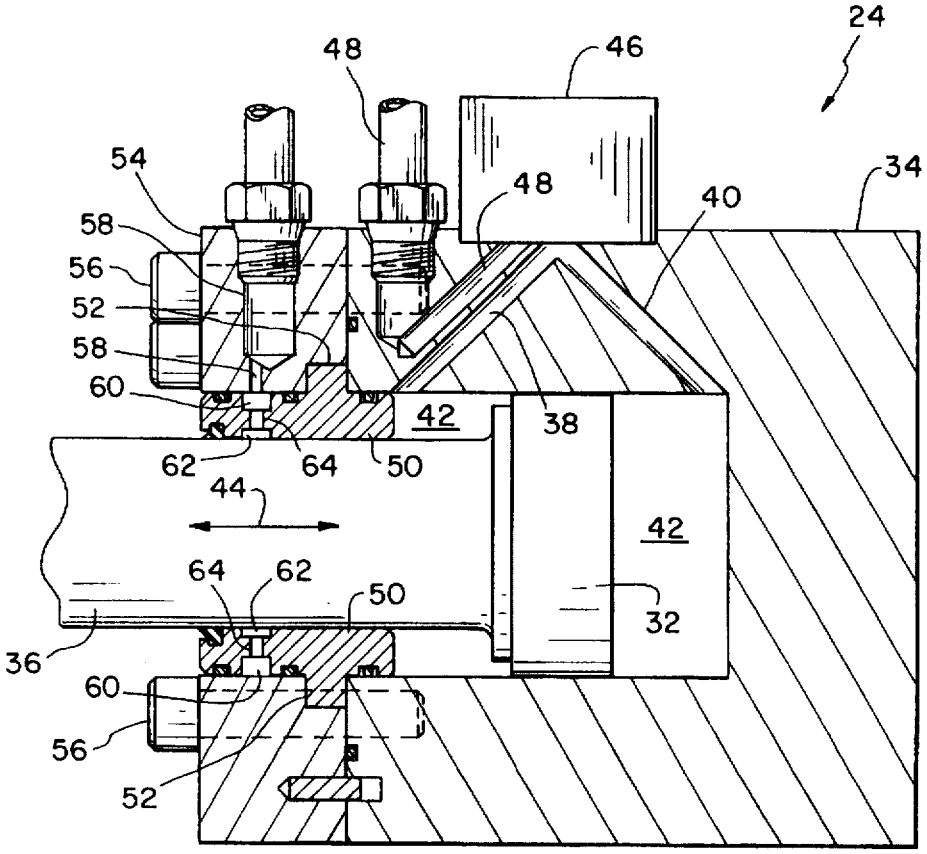
FIG. 2 is an enlarged, sectional view of a hydraulic cylinder assembly shown in FIG. 1.

Referring now to FIG. 2, first hydraulic cylinder assembly 24 shown in FIG. 1 is illustrated in greater detail. It is to be understood that second hydraulic cylinder assembly 26 is configured substantially identical, and thus the following description also pertains thereto.

As indicated above, first hydraulic cylinder assembly 24 includes a piston 32 which is slidably disposed within a cylinder 34. A piston rod 36 is connected to piston 32 and extends from an axial end of cylinder 34. In the embodiment shown in FIG. 2, piston rod 36 is a chrome-plated steel piston rod. To effect two-way positive displacement of piston 32 and piston rod 36, fluid ports 38, 40 are disposed in fluid communication with a chamber 42 defined within cylinder 34. Fluid ports 38, 40 are fluidly connected to cylinder chamber 42 on opposite ends of piston 32, and effect a positive movement of piston 32 within cylinder chamber 42 in either axial direction, as indicated by double-ended arrow 44. Fluid ports 38, 40 are connected to a servo valve 46 which receives hydraulic fluid via an inlet line 48. Servo valve 46 is configured in known manner such that fluid ports 38, 40 selectively and alternatively function as a pressure and return line to effect movement of piston 32 in a selected axial direction 44. The fluid port 38 or 40 which is intermittently functioning as the return line is disposed in fluid communication with a hydraulic reservoir (not shown) into which the hydraulic fluid is returned.

Bushing 50 is connected to cylinder 34 and disposed around piston rod 36. Bushing 50 slidably engages piston rod 36 and substantially seals cylinder chamber 42 from the ambient environment outside first hydraulic cylinder assembly 24. Bushing 50 (shown more particularly in FIGS. 4 and 5) includes a shoulder 52 which is received within a mating groove formed in cylinder 34. Cylinder 34 may be formed with an end cap 54 which is attached to cylinder 34 using appropriate fasteners, such as bolts 56. End cap 54 may include a mating annular groove as shown in FIG. 2 which is sized and shaped for receiving shoulder 52 of bushing 50 therein. End cap 54 also includes an inlet port 58 formed therein. Inlet port 58 is disposed in fluid communication with an outer annular groove 60 and an inner annular groove 62 formed in bushing 50. Hydraulic fluid flows through inlet port 58, and into outer annular groove 60. Outer annular groove 60 is fluidly connected to inner annular groove 62 via radial openings 64 (FIGS. 4 and 5) which are positioned at predetermined locations in bushing 50. Hydraulic fluid disposed within inner annular groove 62 is pressurized by an external source (not shown) via inlet port 58, and thereby forms an oil film between piston rod 36 and bushing 50. The oil film functions to act as a hydrodynamic bearing between piston rod 36 and bushing 50, and also acts as a seal between cylinder chamber 42 and the ambient environment. A plurality of O-rings (not numbered) are disposed in radially outer grooves 66 to further assist in forming a seal between bushing 50 and cylinder 34.

According to one aspect of the present invention, bushing 50 is formed from a non-metallic material which has sufficient physical properties to inhibit scoring thereof by piston rod 36 in the event that an oil film is not present between piston rod 36 and bushing 50 during operation. With a conventional brass or bronze bushing, permanent physical deformation to the brass or bronze bushing may result if the oil film is not present between piston rod 36 and bushing 50. The present invention provides an advantage over such a conventional metallic bushing in that permanent physical deformation of the bushing will not likely result upon the existence of a temporary non-occurrence of an oil film between piston rod 36 and bushing 50.

Figure 4:
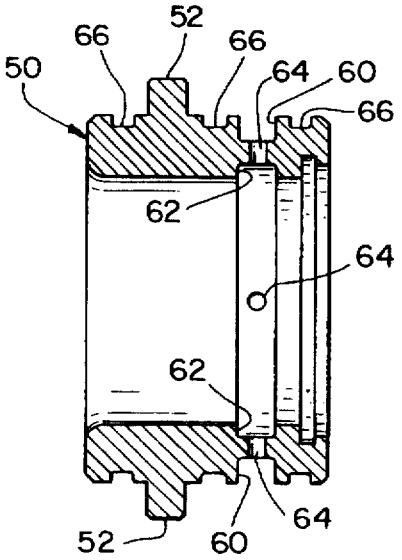
FIG. 4 is side, sectional view of a bushing shown in each of the hydraulic cylinder assemblies of FIGS. 2 and 3.
Figure 5:
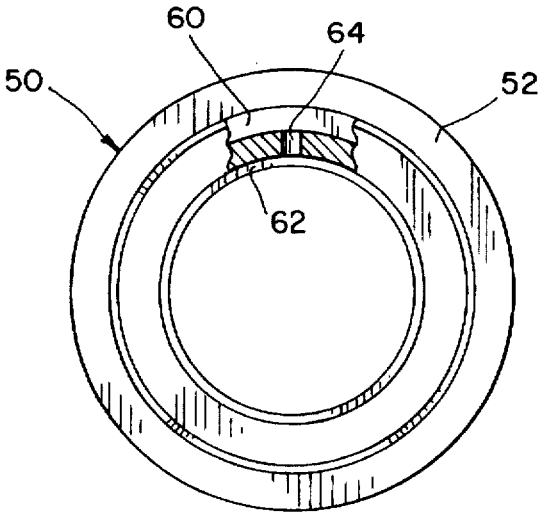
FIG. 5 is a fragmentary, end view of the bushing shown in FIG. 4.

In the embodiment shown in FIGS. 2, 4 and 5, bushing 50 is formed from an SP polyimide resin (e.g., poly-N-N'-(P, P'-oxydiphenylene) pyromellitimide). Such a material is sold under the trademark name "Vespel" by E. I. DuPont de Nemours. Such a material is relatively easy to machine (compared to metal), and has a relatively high tensile strength while at the same time having a relatively low coefficient of friction. For example, such a material has a tensile strength of between approximately 6500 and 12500 psi at a temperature of approximately 73° F., and a tensile strength of between approximately 3500 and 6000 psi at a temperature of approximately 500° F. Moreover, such a material has a coefficient of friction of approximately 0.10 and 0.30 (unlubricated in air). Further, such a material has a maximum continuous operating temperature of approximately 550° F., and a maximum intermittent operating temperature of approximately 900° F.

Figure 3:
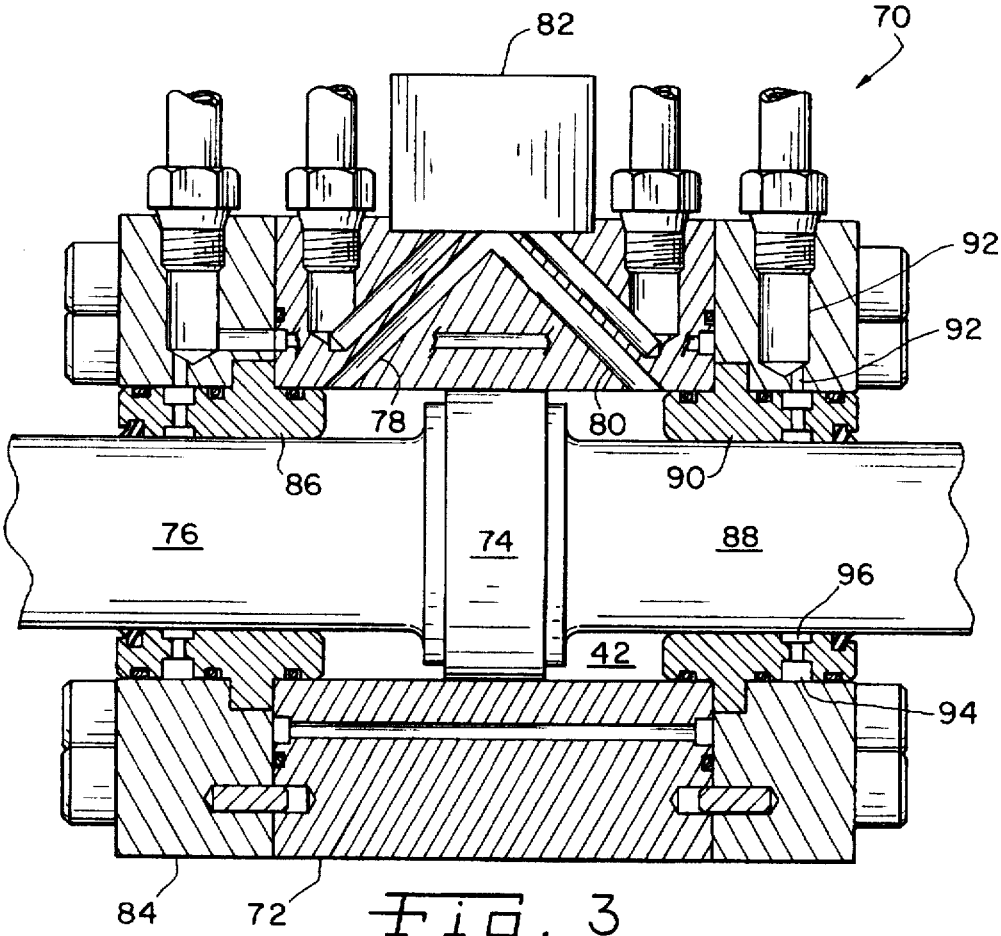
FIG. 3 is an enlarged, sectional view of another embodiment of a hydraulic cylinder assembly which may form a part of the breast roll shake shown in FIG. 1.

Referring now to FIG. 3, another embodiment of a hydraulic cylinder assembly 70 of the present invention is shown. Hydraulic cylinder assembly 70 includes a cylinder 72, piston 74, piston rod 76, fluid ports 78, 80, servo valve 82, end cap 84 and bushing 86 similar to the respectively-named parts shown in FIG. 2. Moreover, hydraulic cylinder assembly 70 also includes a second piston rod 88 connected to piston 74 and extending from an axial end of cylinder 72. Piston rod 76 and second piston rod 88 are connected to piston 74 on opposite ends thereof. A second bushing 90 is connected to cylinder 72 and disposed around second piston rod 88. Second bushing 90 slidably engages second piston rod 88 and substantially seals a cylinder chamber 92 from the ambient environment. Second bushing 90 is formed substantially identical to bushing 86 and is essentially a mirror image to bushing 86. Second bushing 90 is formed from the same kind of material as described above with reference to bushing 86. In particular, second bushing 90 is formed from a material consisting essentially of an SP polyimide resin (e.g., poly-N-N'-(P,P'-oxydiphenylene) pyromellitimide). Such a material has the physical properties, including tensile strength, coefficient of friction and operating temperature as indicated above with reference to bushing 86. An inlet port 92 provides pressurized fluid to an outer annular groove 94 and an inner annular groove 96 of second bushing 90, as described above with reference to inlet port 58. The pressurized fluid within inner annular groove 96 essentially "floats" second piston rod 88 and provides a hydrodynamic bearing between second piston rod 88 and second bushing 90.

Hydraulic cylinder assembly 70 shown in FIG. 3, including piston rod 76 and second piston rod 88, provides the advantage of inhibiting angular displacement between piston rods 76, 88 and cylinder 72. That is, since piston rod 76 and second piston rod 88 are respectively supported at opposing axial ends of cylinder 72, piston 74 does not tip or cant within cylinder 72. This assists in maintaining a substantially uniform hydrodynamic oil film between piston rods 76, 88 and respective bushings 86, 90.

The use of first hydraulic cylinder assembly 24 will now be described with particular reference to FIG. 2. First, pressurized fluid is transported through inlet port 58 to outer annular groove 60 and inner annular groove 62 of bushing 50. This causes an oil film to be created between piston rod 36 and bushing 50 which acts as a hydrodynamic bearing. Piston rod 36 is thus essentially "floated" radially within bushing 50. Thereafter, pressurized fluid is transported from inlet line 48 to servo valve 46, which controls the directions of fluid flow to and from cylinder chamber 42 on either end of piston 32. One of fluid ports 38, 40 selectively acts as a pressure line, while the other of fluid ports 38, 40 acts as a return line. Piston 32 may be moved in one direction or another depending upon which of fluid ports 38, 40 is being utilized as the pressure line.

In contrast with conventional structures, bushing 50 of the present invention is not permanently deformed upon the occurrence of an intermittent loss of fluid pressure within inlet port 58. The relatively low coefficient of friction of bushing 50 (relative to metallic bushings) reduces frictional wear between piston rod 36 and bushing 50 in the event of a loss of system pressure within inlet port 58. Moreover, the relatively high continuous and operating temperature of bushing 50 prevents melting of bushing 50 (via frictional heat generation) if system pressure is lost within inlet port 58. (A plastic such as nylon melts at about 500° F., and may melt upon the occurrence of heat generated between piston rod 36 and the bushing in the absence of an oil film therebetween).

In the embodiment shown in FIG. 1, first hydraulic cylinder assembly 24 is shown being connected to and imparting axial motion to breast roll 12. However, it is to be understood that the hydraulic cylinder assembly of the present invention may be connected to a different type of roll within a paper machine. For example, a hydraulic cylinder assembly 24, 26 or 70, as shown in the drawings of the present application, may be connected to a roll and used to lift the roll or apply a nip load to the roll. A roll having a nip loading applied thereto may experience vibrations which would wear out a conventional metallic bushing of a hydraulic cylinder assembly. However, the non-metallic bushing of the present invention having a relatively high tensile strength, low coefficient of friction, and high operating temperature effectively operates in such an environment.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. In a paper machine for one of making and processing a paper web, comprising a roll for carrying the paper web;

a hydraulic cylinder assembly connected to said roll for moving said roll, said hydraulic cylinder assembly including a cylinder defining a chamber, a piston disposed within said cylinder, and a piston rod connected to said piston and extending from said cylinder, said hydraulic cylinder assembly further including a bushing connected to said cylinder and disposed around said piston rod, said bushing slidably engaging said piston rod and substantially sealing said cylinder chamber from an ambient environment, the improvement wherein said bushing comprises a non-metallic material having a tensile strength of between approximately 6500 and 12500 psi at a temperature of approximately 73° F., a coefficient of friction of between approximately 0.10 and 0.30, and a maximum continuous operating temperature of approximately 550° F.

2. The paper machine of claim 1, wherein said bushing is comprised of a material consisting essentially of an SP polyimide resin.

3. The paper machine of claim 2, wherein said bushing is comprised of a material consisting essentially of poly-N-N'-(P,P'-oxydiphenylene) pyromellitimide.

4. The paper machine of claim 1, wherein said hydraulic cylinder assembly further includes a second piston rod connected to said piston and extending from said cylinder, said piston rod and said second piston rod connected to opposite ends of said piston, said hydraulic cylinder assembly also including a second bushing connected to said cylinder and disposed around said second piston rod, said second bushing slidably engaging said second piston rod and substantially sealing said cylinder chamber from the ambient environment, said second bushing comprised of a non-metallic material having a tensile strength of between approximately 6500 and 12500 psi at a temperature of approximately 73° F., a coefficient of friction of between approximately 0.10 and 0.30, and a maximum continuous operating temperature of approximately 550° F.

5. The paper machine of claim 1, wherein said hydraulic cylinder assembly further includes fluid ports connected to said cylinder chamber on opposite ends of said piston, said fluid ports selectively effecting a positive movement of said piston within said cylinder chamber in either direction.

6. The paper machine of claim 1, wherein said roll comprises a breast roll, and wherein said hydraulic cylinder assembly is structured and arranged as part of a breast roll shake.

7. In a paper machine for one of making and processing a paper web, comprising a roll for carrying the paper web;

a hydraulic cylinder assembly connected to said roll for moving said roll, said hydraulic cylinder assembly including a cylinder defining a chamber, a piston disposed within said cylinder, and a piston rod connected to said piston and extending from said cylinder, said hydraulic cylinder assembly further including a bushing connected to said cylinder and disposed around said piston rod, said bushing slidably engaging said piston rod and substantially sealing said cylinder chamber from an ambient environment, the improvement wherein said bushing comprises a material consisting essentially of poly-N-N'-(P,P'-oxydiphenylene) pyromellitimide.

8. The paper machine of claim 7, wherein said bushing has a tensile strength of between approximately 6500 and 12500 psi at a temperature of approximately 73° F.

9. The paper machine of claim 7, wherein said bushing has a tensile strength of between approximately 3500 and 6000 psi at a temperature of approximately 50020 F.

10. The paper machine of claim 7, wherein said bushing has a coefficient of friction of between approximately 0.10 and 0.30, unlubricated in air.

11. The paper machine of claim 7, wherein said bushing has a maximum continuous operating temperature of approximately 550° F.

12. The paper machine of claim 11, wherein said bushing has an intermittent maximum operating temperature of approximately 900° F.

13. The paper machine of claim 7, wherein said hydraulic cylinder assembly further includes a second piston rod connected to said piston and extending from said cylinder, said piston rod and said second piston rod connected to opposite ends of said piston, said hydraulic cylinder assembly also including a second bushing connected to said cylinder and disposed around said second piston rod, said second bushing slidably engaging said second piston rod and substantially sealing said cylinder chamber from the ambient environment, said second bushing comprised of a material consisting essentially of poly-N-N'-(P,P'-oxydiphenylene) pyromellitimide.

14. The paper machine of claim 7, wherein said hydraulic cylinder assembly further includes fluid ports connected to said cylinder chamber on opposite ends of said piston, said fluid ports selectively effecting a positive movement of said piston within said cylinder chamber in either direction.

15. The paper machine of claim 7, wherein said roll comprises a breast roll, and wherein said hydraulic cylinder assembly is structured and arranged as part of a breast roll shake.

16. The paper machine of claim 7, wherein said piston rod comprises a chrome-plated steel piston rod.

* * * * *

UNITED STATES PATENT AND TRADEMARK OFFICE

CERTIFICATE OF CORRECTION

PATENT NO. : 5,759,354

DATED : Jun. 2, 1998

INVENTOR(S) : Edwin X. Graf

It is certified that error appears in the above-identified patent and that said Letters Patent is hereby corrected as shown below:

Column 2

Line 28, delete "0.13" and substitute --0.30-- therefor.

Signed and Sealed this

Twenty-fifth Day of May, 1999

*Attest:*

Q. TODD DICKINSON

*Attesting Officer*

*Acting Commissioner of Patents and Trademarks*